US007467889B2

(12) United States Patent
Abe et al.

(10) Patent No.: US 7,467,889 B2
(45) Date of Patent: Dec. 23, 2008

(54) HYDRAULIC DRIVING DEVICE FOR CONCRETE AGITATING DRUM RESPONSIVE TO ENGINE SPEED

(75) Inventors: Masaya Abe, Tokyo (JP); Kunihiro Ando, Tokyo (JP); Yoshihito Iwasaki, Tokyo (JP)

(73) Assignee: Kayaba Industry Co., Ltd., Tokyo (JP)

( * ) Notice: Subject to any disclaimer, the term of this patent is extended or adjusted under 35 U.S.C. 154(b) by 84 days.

(21) Appl. No.: 11/806,617

(22) Filed: Jun. 1, 2007

(65) Prior Publication Data

US 2008/0008025 A1 Jan. 10, 2008

(30) Foreign Application Priority Data

Jun. 2, 2006 (JP) ..... 2006-154718

(51) Int. Cl.
*B28C 5/42* (2006.01)

(52) U.S. Cl. ..... 366/61; 60/465

(58) Field of Classification Search ..... 366/53–63, 366/232–233; 60/462–465
See application file for complete search history.

(56) References Cited

U.S. PATENT DOCUMENTS 5,746,509 A * 5/1998 Gebhard et al. ..... 60/464
6,074,083 A * 6/2000 Gebhard et al. ..... 60/464
6,286,987 B1 * 9/2001 Goode et al. ..... 366/60
2007/0280035 A1 * 12/2007 Abe et al.
2008/0008025 A1 * 1/2008 Abe et al. ..... 366/61

FOREIGN PATENT DOCUMENTS

DE 3213926 A1 * 10/1983
GB 2103339 A * 2/1983
JP 2000094432 A * 4/2000
JP 2000-272405 10/2000
JP 2000272406 A * 10/2000
JP 2007320477 A * 12/2007

* cited by examiner

*Primary Examiner*—Charles E Cooley
(74) *Attorney, Agent, or Firm*—Rabin & Berdo, PC

(57) ABSTRACT

An agitating drum driving device comprises a hydraulic motor (81) for rotating an agitating drum (1), and a swash-plate type hydraulic pump (10) connected to a combustion engine (60) to supply pressurized oil to drive the hydraulic motor (81). When the engine rotation speed is not higher than a predetermined speed, the swash-plate angle of a swash-plate (64) is regulated to keep a differential pressure between a pressure of the pressurized oil and a load pressure acting on the hydraulic motor (81) constant. When the engine rotation speed rises above the predetermined speed, the flow rate of the pressurized oil is increased as the engine rotation speed increases while relatively decreasing an increasing rate of the flow rate of the pressurized oil with respect to an increase rate of the engine rotation speed as the engine rotation speed increases.

9 Claims, 4 Drawing Sheets

HYDRAULIC DRIVING DEVICE FOR CONCRETE AGITATING DRUM RESPONSIVE TO ENGINE SPEED

FIELD OF THE INVENTION

This invention relates to an agitating drum driving device for a concrete agitating truck using a variable capacity hydraulic pump and a hydraulic motor.

BACKGROUND OF THE INVENTION

A ready-mixed concrete agitating truck is equipped with a concrete agitating drum for agitating and discharging ready-mixed concrete supplied from a hopper or the like. The agitating drum is driven by a hydraulic motor.

JP2000-272405A, published by the Japan Patent Office in 2000, proposes a hydraulic drive circuit for such a concrete agitating drum.

In this hydraulic drive circuit, the hydraulic motor is supplied with pressurized oil from a variable capacity hydraulic pump. The variable capacity hydraulic pump comprises an actuator which varies a pump discharge flow rate. The actuator operates in response to a pump discharge pressure of the variable capacity hydraulic pump.

A load sensing valve regulates the pump discharge pressure supplied to the actuator, thereby maintaining a differential pressure between the pump discharge pressure and a load pressure under which the hydraulic motor operates at a constant value. When the differential pressure is maintained at a constant value, the flow rate of the pressurized oil supplied from the variable capacity hydraulic pump to the hydraulic motor is also maintained at a constant value. As a result, even when a rotation speed of the variable capacity hydraulic pump, which is driven by an internal combustion engine varies, the rotation speed of the agitating drum is maintained at a constant rotation speed.

SUMMARY OF THE INVENTION

However, it is difficult to maintain the discharge flow rate of the hydraulic pump at a constant value throughout the engine rotation speed range from an idle rotation speed region to a high rotation speed region by simply varying the capacity of the variable capacity hydraulic pump.

In order to maintain the discharge flow rate of the hydraulic pump, it may be necessary to regulate an output torque of the internal combustion engine. For example, within a range from the idle rotation speed region to a low rotation speed region, it may be necessary to increase a fuel supply amount to the internal combustion engine to input a sufficient rotating torque into the hydraulic pump when the internal combustion engine operates within a range from the idle rotation speed region to the low rotation speed region. However, engine control of this kind increases the fuel consumption amount of the internal combustion engine It is therefore an object of this invention to reduce a fuel consumption amount of an internal combustion engine which is used as a power source for driving an agitating drum for ready-mixed concrete.

In order to achieve the above object, this invention provides a concrete agitating drum driving device comprising a hydraulic motor connected to a concrete agitating drum, a hydraulic pump driven by a combustion engine and causing the hydraulic motor to rotate by supplying pressurized oil thereto, a hydraulic actuator which regulates a flow rate of the pressurized oil in response to an actuator driving pressure, and a load sensing valve which generates the actuator driving pressure by reducing a pressure of the pressurized oil to maintain a differential pressure between the pressure of the pressurized oil and a load pressure under which the hydraulic motor operates at a constant level when an engine rotation speed of the combustion engine is not higher than a predetermined speed.

The agitating drum driving device further comprises a mechanism which, when the engine rotation speed is higher than the predetermined speed, increases the flow rate of the pressurized oil as the engine rotation speed increases, while relatively decreasing an increase rate of the flow rate with respect to an increase rate of the engine rotation speed as the engine rotation speed increases.

The details as well as other features and advantages of this invention are set forth in the remainder of the specification and are shown in the accompanying drawings.

DESCRIPTION OF THE PREFERRED EMBODIMENTS

Figure 1A:
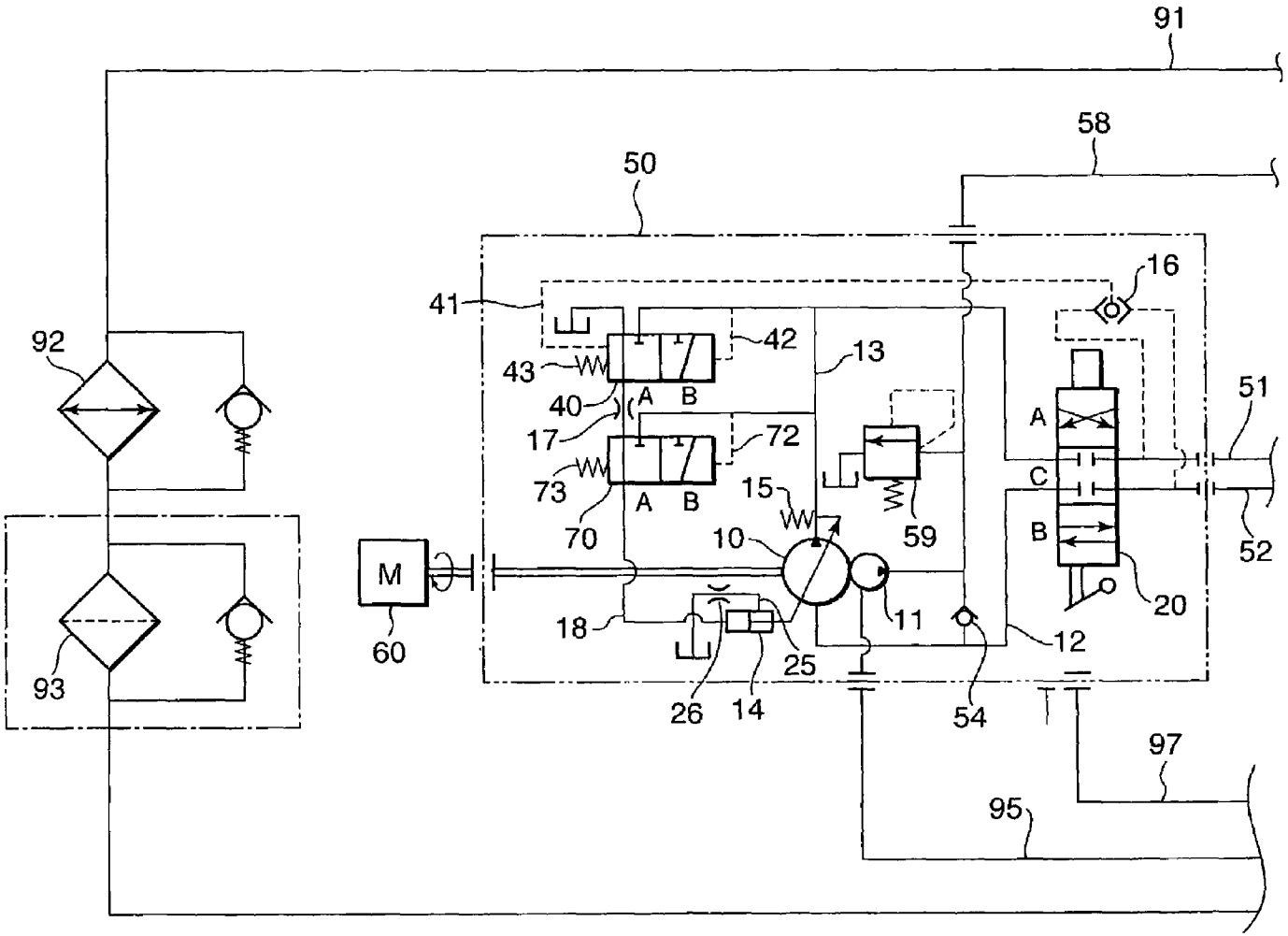
FIGS. 1A and 1B are a hydraulic circuit diagram of a concrete agitating drum driving device according to this invention.
Figure 1B:
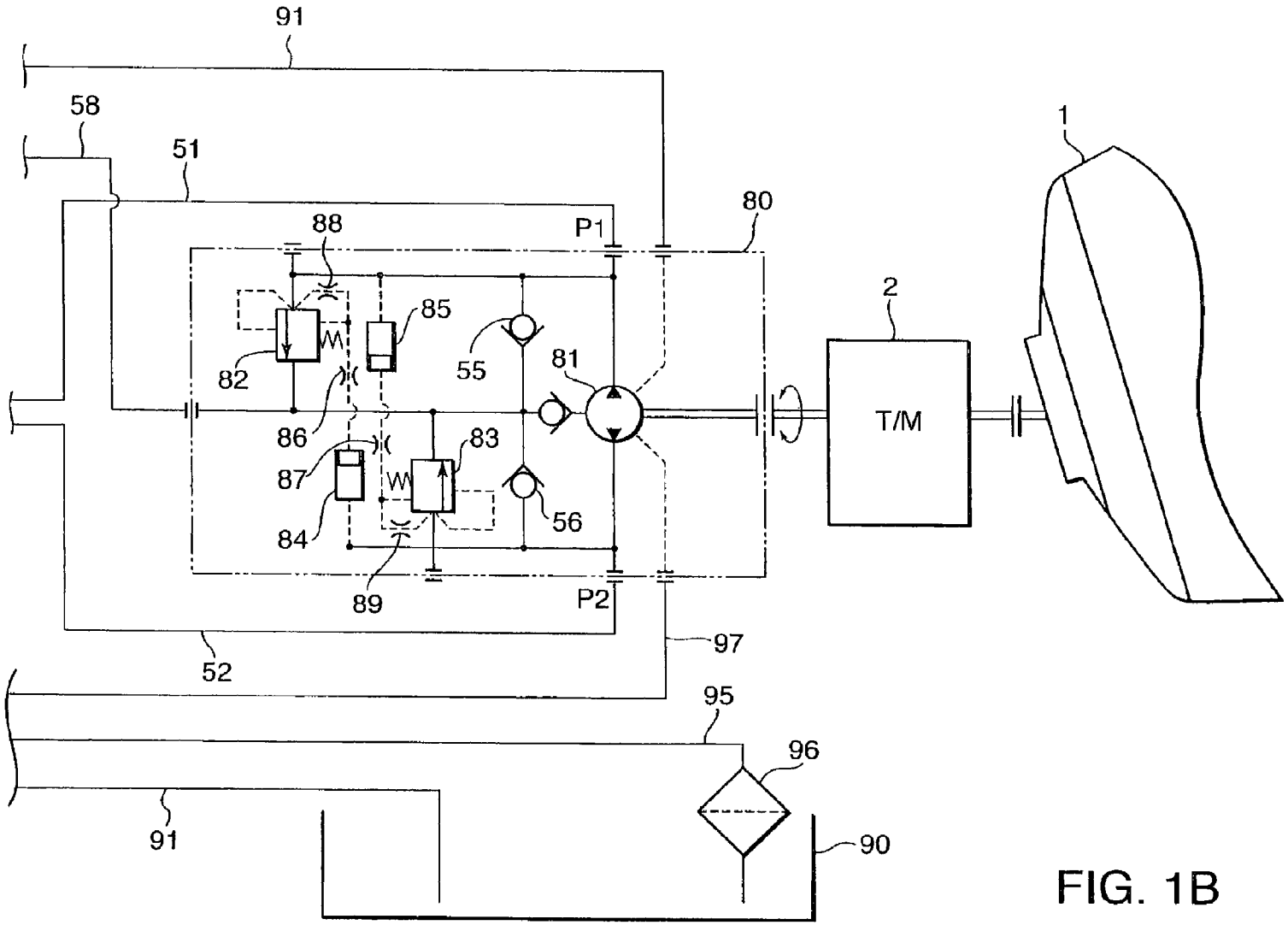

Referring to FIGS. 1A and 1B of the drawings, a concrete agitating drum driving device for a ready-mixed concrete agitating truck comprises a pump unit 50, a motor unit 80, a reservoir 90, and hydraulic passages connecting these units and the reservoir.

The motor unit 80 comprises a hydraulic motor 81 which rotates a concrete agitating drum 1 via a transmission 2.

The hydraulic motor 81 comprises two ports to which a first hydraulic passage 51 and a second hydraulic passage 52 are connected respectively. The hydraulic motor 81 rotates in a normal direction as well as in a reverse direction according to a hydraulic pressure supplied selectively to the first hydraulic passage 51 and the second hydraulic passage 52.

A relief valve 82 is connected to the first hydraulic passage 51. A pressure in the first hydraulic passage 51 is input into the relief valve 82 as a pilot pressure to open the relief valve 82. A pressure in the second hydraulic passage 52 is input into the relief valve 82 via a piston unit 84 and an orifice 86 as a pilot pressure to close the relief valve 82. The pressure in the first hydraulic passage 51 is also input into the relief valve 83 via an orifice 85 as another pilot pressure to close the relief valve 82. In response to the variations in these pilot pressures, the relief valve 82 opens when the pressure in the first hydraulic passage 51 increases rapidly with respect to the pressure in the second hydraulic passage 52 to release a part of the working oil in the first hydraulic passage 51 into a charging passage 58, and closes after a while. The relief valve 82 thereby absorbs a shock which the hydraulic motor 81 may encounter due to a rapid change in the pressure in the first hydraulic passage 51.

A relief valve 83 is connected to the second hydraulic passage 52. A pressure in the second hydraulic passage 52 is input into the relief valve 83 as a pilot pressure to open the relief valve 83. A pressure in the first hydraulic passage 51 is input into the relief valve 83 via a piston unit 85 and an orifice 87 as a pilot pressure to close the relief valve 83. A pressure in the second hydraulic passage 52 is also input into the relief valve 83 via an orifice 89 as another pilot pressure to close the relief valve 83. In response to the variations in these pilot pressures, the relief valve 83 opens when the pressure in the second hydraulic passage 52 increases rapidly with respect to the pressure in the first hydraulic passage 51 to release a part of the working oil in the second hydraulic passage 52 into the charging passage 58, and closes after a while. The relief valve 83 thereby absorbs a shock which the hydraulic motor 81 may encounter due to a rapid change in the pressure in the second hydraulic passage 52.

To summarize the above, the relief valves 82 and 83 provide a function generally known as a shock-less structure.

The charging passage 58 is connected to the first hydraulic passage 51 via a check valve 55. The charging passage 58 is also connected to the second hydraulic passage 52 via a check valve 56.

The interior of a casing of the motor unit 80 and the reservoir 90 communicate with each other via a drain passage 91. An oil cooler 92 and an oil filter 93 are provided in the drain passage 91.

The pump unit 50 comprises a hydraulic pump 10 driven by an internal combustion engine 60, a charge pump 11, a relief valve 59, a connection switch-over valve 20, a load sensing valve 40, a cutoff valve 70, and a high pressure selector valve 16.

The first hydraulic passage 51 and the second hydraulic passage 52 are connected to a suction passage 12 and a discharge passage 13 of the hydraulic pump 10 of the pump unit 50 via the connection switch-over valve 20. In other words, a closed hydraulic circuit is formed between the hydraulic motor 81 and the hydraulic pump 10.

The hydraulic pump 10 pressurizes working oil suctioned from the suction passage 12 and discharges the oil into the discharge passage 13. The suction passage 12 is filled with the working oil supplied from the charge pump 11 via a check valve 54.

The charge pump 11 rotates in synchronization with the hydraulic pump 10 and supplies the charging passage 58 with working oil from the reservoir 90 via a passage 95. The working oil in the charging passage 58 has a function to fill the first hydraulic passage 51 via a check valve 55 and the second hydraulic passage 52 via a check valve 56.

The charging passage 58 communicates with the reservoir 90 via the relief valve 59. The relief valve 59 returns surplus working oil discharged form the charge pump 11 to the reservoir 90, when the pressure in the charging passage 58 rises above a predetermined relief pressure.

The working oil suctioned by the charge pump 11 is supplied from the reservoir 90 via the passage 95. A strainer 96 is provided in the passage 95. A casing of the pump unit 50 and a casing of the motor unit 80 communicate with each other via a drain passage 97.

The hydraulic pump 10 rotates in synchronization with the internal combustion engine 60. A pump rotation speed of the hydraulic pump 10 is therefore equal to an engine rotation speed of the internal combustion engine 60.

The suction passage 12, the discharge passage 13, the first hydraulic passage 51, and the second hydraulic passage 52 are connected to the connection switch-over valve 20. The connection switch-over valve 20 switches over three sections A-C by a manual operation performed by an operator.

In the section A, the connection switch-over valve 20 connects the suction passage 12 to the first hydraulic passage 51 while connecting the discharge passage 13 to the second hydraulic passage 52.

In the section B, the connection switch-over valve 20 connects the discharge passage 13 to the first hydraulic passage 51 while connecting the suction passage 12 to the second hydraulic passage 52.

In the section C, the connection switch-over valve 20 shuts off the suction passage 12 and discharge passage 13 from the first hydraulic passage 51 and second hydraulic passage 52, respectively. The connection switch-over valve 20 thereby switches over the normal rotation, the reverse rotation, and the rotation stop of the hydraulic motor 81.

A swash-plate type piston pump is used as the hydraulic pump 10. The discharge flow rate of the hydraulic pump 10 is regulated by an actuator 14 which regulates a swash-plate angle of the hydraulic pump 10 in response to a an actuator driving pressure which is supplied from the load sensing valve 40 and the cutoff valve 70. For this purpose, the actuator 14 and the cutoff valve 70 are connected by an actuator passage 18. The actuator 14 reduces the discharge flow rate of the hydraulic pump 10 as the hydraulic pressure in the actuator passage 18 rises.

The cutoff valve 70 has two sections A and B. In the section A, the cutoff valve 70 connects the actuator passage 18 to the load sensing valve 40. In the section B, the cutoff valve 70 connects the actuator passage 18 to the discharge passage 13. The cutoff valve 70 switches these sections in response to a pilot pressure input from a pilot pressure passage 72 extending from the discharge passage 13.

The cutoff valve 70 comprises a spring 73 applying a resilient force to the cutoff valve 70 in a direction for applying the section A. The pilot pressure in the pilot pressure passage 72 pushes the cutoff valve 70 in the reverse direction to the resilient force of the spring 73. The resilient force of the spring 73 is set such that the cutoff valve 70 switches from the section A to the section B when the pilot pressure in the pilot pressure passage 72 reaches a predetermined pressure which is generally in a range of 10-40 megapascal (MPa). Such a situation occurs, when the connection switch-over valve 20 has switched over to the section C and the discharge passage 13 is thereby shut off in a state where the hydraulic pump 10 is in operation.

In contrast, the cutoff valve 70 maintains the section A when the pilot pressure is less than the predetermined pressure. In the section A, the cutoff valve 70 connects the actuator passage 18 to the load sensing valve 40 via an orifice 17. This situation corresponds to the situation when the agitating drum 1 is operative.

The load sensing valve 40 has two sections A and B. When the cutoff valve 70 is in the section A and the load sensing valve 40 is in the section A, the pressure in the actuator passage 18 is released to the reservoir. When the cutoff valve 70 is in the section A and the load sensing valve 49 is in the section B, the actuator passage 18 is connected to the discharge passage 13.

The load sensing valve 40 switches over in response to a differential pressure between a load pressure in the first hydraulic passage 51 or the second hydraulic passage 52 and the pressure in the discharge passage 13. Herein, the load pressure is a pressure exerted on the hydraulic motor 81 to rotate the agitating drum 1. The pressure in the discharge passage 13 corresponds to a discharge pressure of the hydraulic pump 10. The differential pressure is proportional to the flow rate of the discharge passage 13.

The load sensing valve 40 regulates the pressure in the actuator passage 18 by connecting the actuator passage 18 to the discharge passage 13 and the reservoir in a proportion which is preset according to the differential pressure. In other words, the discharge pressure of the hydraulic pump 10 is reduced in response to the differential pressure and then supplied to the actuator passage 18 as the actuator driving pressure.

For this purpose, the load sensing valve 40 comprises a spring 43 which applies a resilient force to the load sensing valve 40 in a direction for applying the section A. The load sensing valve 40 also comprises a first pilot passage 41 which applies a pilot pressure on the load sensing valve 40 in the same direction as the resilient force of the spring 43, and a second pilot passage 42 which applies a pilot pressure on the load sensing valve 40 in the reverse direction to the resilient force of the spring 43.

The first pilot passage 41 is connected to the first hydraulic passage 51 and the second hydraulic passage 52 via a high pressure selector valve 16. The high pressure selector valve 16 inputs the higher pressure of the hydraulic pressures in the first hydraulic passage 51 and the second hydraulic passage 52 into the first pilot passage 41. In other words, the high pressure selector valve 16 inputs the load pressure of the hydraulic motor 81 to the first pilot passage 41. The second pilot passage 42 is connected to the discharge passage 13. The high pressure selector valve 16 may be constituted by a shuttle valve, for example.

According to the above construction, when the agitating drum 1 is operated, the actuator 14 decreases the swash-plate angle of the hydraulic pump 10 as the differential pressure between the discharge pressure of the hydraulic pump 10 and the load pressure of the hydraulic motor 81 increases, and increases the swash-plate angle of the hydraulic pump 10 as the differential pressure decreases.

When the agitating drum 1 is to stop operation, the connection switch-over valve 20 is switched to the section C so as to shut off the discharge passage 13 form the hydraulic motor 81. As a result, the discharge pressure of the hydraulic pump 10 rapidly increases, and accordingly the cutoff valve 70 switches from the section A to the section B. In this situation, the discharge pressure of the hydraulic pump 10 in the discharge passage 13 is directly supplied as the actuator driving pressure to the actuator 14 without being reduced. Under this high pressure, the actuator 14 drives the swash-plate of the hydraulic pump 10 against the resilient force of the spring 15 to a full-stroke position in which the discharge flow rate of the hydraulic pump 10 becomes zero.

The agitating drum driving device according to this invention further comprises a mechanism which varies a discharge flow rate characteristic of the hydraulic pump 10 with respect to the engine rotation speed. The mechanism increases the discharge flow rate of the hydraulic pump 10 as the engine rotation speed increases when the engine rotation speed is higher than a predetermined speed, while decreasing an increase rate of the discharge flow rate of the hydraulic pump 10 with respect to an increase rate of the engine rotation speed as the engine rotation speed increases. The predetermined speed corresponds to an upper limiting speed of the low rotation speed region and is set to 600-800 revolutions per minute, for example.

The mechanism comprises a drain passage 25 which releases a part of the hydraulic pressure acting on the actuator 14 when the actuator 14 strokes in a direction to decrease the discharge flow rate of the hydraulic pump 10 beyond a predetermined stroke distance. An orifice 26 is disposed in the drain passage 25.

Figure 2:
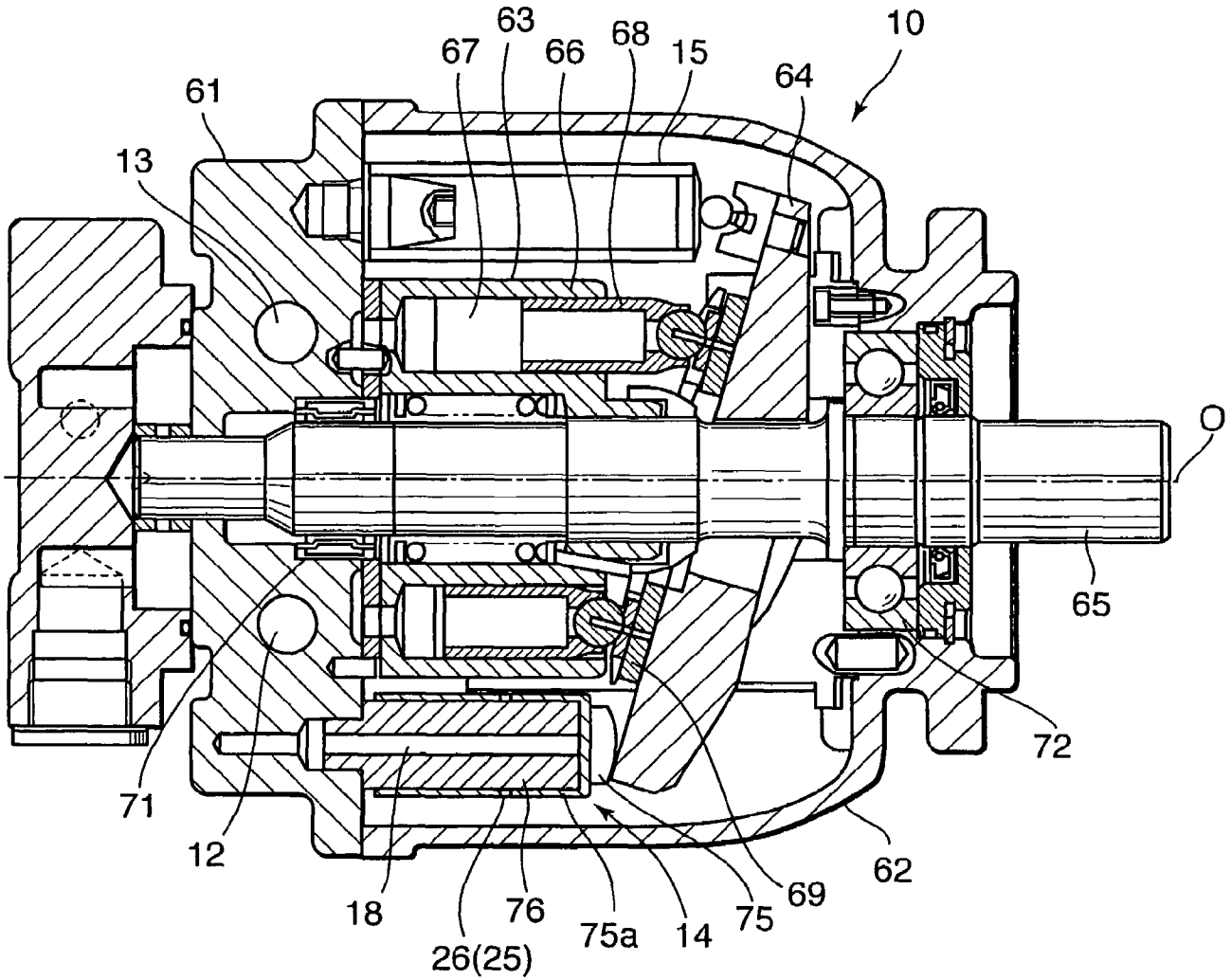
FIG. 2 is a longitudinal sectional view of a hydraulic pump with which the concrete agitating drum driving device is provided.

Referring to FIG. 2, the detailed construction of the orifice 26 and the drain passage 25 will be described.

The hydraulic pump 10 is a rotating swash-plate type and comprises a cylinder block 63 and a swash-plate 64 which are enclosed in a space formed by a pump housing 62 and a pump cover 61 fixed thereto.

The cylinder block 63 is driven to rotate by a shaft 65. The shaft 65 is supported by the pump housing 62 via a bearing 72. A tip of the shaft 65 is supported by the pump cover 61 via a bearing 71. Another tip of the shaft 65 penetrates the pump housing 62 to the out side and is connected to the internal combustion engine 60.

A plurality of cylinders 66 are disposed in the cylinder block 63 in parallel with a center axis O of the shaft 65 and along a circle about the center axis O at regular intervals.

A piston 68 is inserted into each of the cylinders 66. A pressure chamber 67 is formed in the cylinder 66 by the piston 68. A tip of the piston 68 projects from the cylinder 66 in an axial direction and contacts the swash-plate 64 via a shoe. When the cylinder block 63 rotates, each of the pistons 68 is driven in the axial direction by the swash-plate 64 so as to expand/contract the pressure chamber 67 cyclically.

In order to make the discharge flow rate of the hydraulic pump 10 variable, the swash-plate 64 is supported by the pump housing 62 via a trunnion shaft so as to be free to gyrate about the trunnion shaft. A spring 15 disposed in the pump housing 62 supports the swash-plate 64 in a direction to increase the swash-plate angle of the swash-plate 64.

The actuator 14 is a linear actuator and comprises an inner tube 76 and a plunger 75 which is in contact with the swash-plate 64. The inner tube 76 is fixed to the pump cover 61 in parallel with the center axis O of the shaft 65. The actuator passage 18 penetrates the center of the inner tube 76 in the direction along the center axis O. On the outer circumference of the inner tube 76, an outer tube **76*a* which forms a base of a plunger 75** is fitted so as to be free to slide in the direction along the center axis O.

The pressure in the actuator passage 18 acts on the rear side of the plunger 75 from within the outer tube **75*a*. As a result, the plunger 75 pushes the swash-plate 64 towards the right hand side in the figure to decrease the swash-plate angle against the resilient force of the spring 15. As the pressure in the actuator passage 18 increases, therefore, the swash-plate angle of the hydraulic pump 10** decreases.

The orifice 26 described heretofore is formed to penetrate a wall face of the outer tube **75*a* of the plunger 75. In this embodiment, a plurality of orifices 26** are formed.

The outer circumference of the outer tube **75*a* is exposed in the interior of the pump housing 62. In contrast, the inner circumference of the outer tube 75*a* is in contact with the outer circumference of the inner tube 76 when the plunger 75 is in the position shown in the figure. In this situation, therefore, the orifices 26 are closed. When the plunger 75 displaces towards the right hand side of the figure such that the orifices 26 are connected to the actuator passage 18, the orifices 26 release a part of the working oil in the actuator passage 18 to a space in the pump housing 62. This space is maintained at a low pressure, and hence can be regarded as a reservoir. The orifices 26 function also as the drain passage 25 in this construction of the hydraulic pump 10**.

When the orifices 26 release a part of the working oil in the actuator passage 18, the stroke distance of the plunger 75 with respect to a pressure increase in the discharge passage 13 becomes notably small. The orifices 26 and the drain passage 25 thus constitute a mechanism for varying a discharge flow rate characteristic of the hydraulic pump 10 with respect to the engine rotation speed.

It should be noted the orifices 26 decrease the increase rate of the discharge flow rate of the hydraulic pump 10 while allowing the plunger 75 to project to the full-stroke position depending on the hydraulic pressure in the actuator passage 18. As described heretofore, when stopping the operation of the agitating drum 1, it is necessary to make the swash-plate angle zero so as to cause the discharge flow rate of the hydraulic pump 10 to become zero.

In order to stop rotation of the agitating drum 1, the connection switch-over valve 20 is switched to the section C, and a resultant rapid increase in the discharge pressure of the hydraulic pump 10 causes the plunger to move to the full-stroke position in which the swash-plate angle becomes zero. The size and number of the orifices 26 are therefore determined so as not to prevent this full-stroke motion of the plunger 75.

When the agitating drum 1 operates, the internal combustion engine 60 drives the hydraulic pump 10 to rotate. The hydraulic pump 10 then suctions low-pressure working oil in the suction passage 12 and discharges pressurized working oil into the discharge passage 13. By shifting the connection switch-over valve 20 to any one of the sections A and B, one of the first hydraulic passage 51 and the second hydraulic passage 52 is supplied with the pressurized working oil and the low-pressure working oil is recirculated from the other of the first hydraulic passage 51 and the second hydraulic passage 52 to the suction passage 12. By circulating the working oil between the hydraulic pump 10 and the hydraulic motor 81 in this way, the hydraulic motor 81 rotates, and the rotation is transmitted to the agitating drum 1 via the transmission 2.

The load sensing valve 40 regulates the actuator driving pressure supplied to the actuator 14 such that the differential pressure between the discharge pressure of the hydraulic pump 10 in the discharge passage 13 and the load pressure of the hydraulic motor 81 which appears in either of the first hydraulic passage 51 and the second hydraulic passage 52 is maintained at a predetermined pressure.

When the internal combustion engine 60 is running idle, or when it is running in a low rotation speed region, the hydraulic pump 10 increases the swash-plate angle so as to compensate for the low rotation speed. The actuator 14 in this state operates within a stroke distance range in which the orifices 26 are closed. The actuator 14 regulates the swash-plate angle of the hydraulic pump 10 such that the differential pressure between the discharge pressure of the hydraulic pump 10 and the load pressure of the hydraulic motor 81 is maintained at a constant value, or in other words such that the discharge flow rate of the hydraulic pump 10 is maintained at a constant flow rate.

Figure 3:
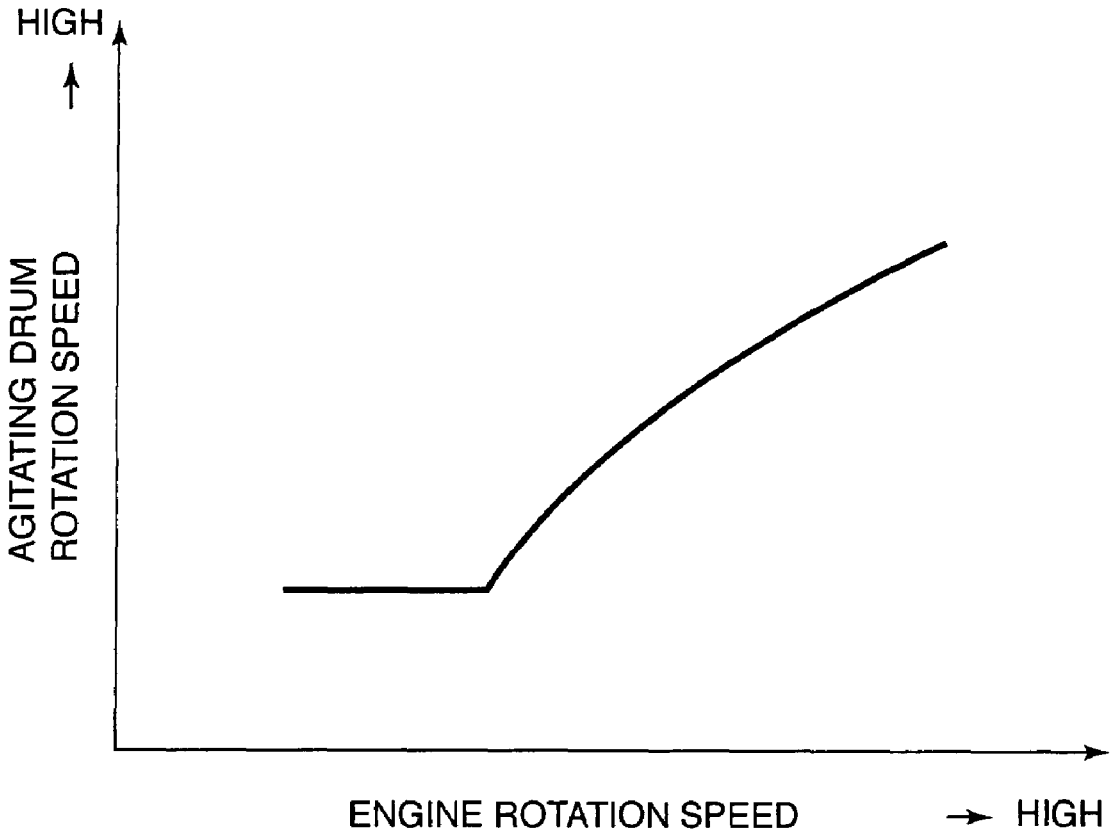
FIG. 3 is a diagram showing a rotation speed characteristic of a concrete agitating drum with respect to an engine rotation speed according to this invention.

Referring to FIG. 3, when the internal combustion engine 60 is running idle or running in the low rotation speed region, the actuator 14 decreases the swash-plate angle of the hydraulic pump 10 as the rotation speed of the internal combustion engine 60 or the rotation speed of the hydraulic pump 10 increases.

As a result, the flow rate of the pressurized oil supplied from the hydraulic pump 10 to the hydraulic motor 81, or in other words, the rotation speed of the agitating drum 1, is kept constant.

However, this rotation speed level of the agitating drum 1 in this state is lower than a rated rotation speed of the agitating drum 1.

As the rotation speed of the internal combustion engine 60 increases further, the actuator 14 increases the stroke distance of the plunger 75, and the orifices 26 finally communicate with the space in the pump housing 62. The orifices 26 release a part of the hydraulic pressure of the hydraulic pump 10 to the space in the pump housing 62 under a predetermined flow resistance. Therefore, the decrease in the swash-plate angle with respect to an increase in the discharge flow rate of the hydraulic pump 10 is more gradual than in the case where the orifices 26 are closed. As a result, in the middle and high rotation speed regions of the internal combustion engine 60, the rotation speed of the agitating drum 1 gradually increases as the engine rotation speed increases, as illustrated in the figure. The rotation speed of the agitating drum 1 reaches the rated rotation speed in this way.

Herein, instead of forming the orifices 26 in the outer tube 75*a*, it is possible to provide a stopper that prevents the swash-plate 64 from decreasing the swash-plate angle beyond a predetermined angle, thereby ensuring an increase in the rotation speed of the agitating drum 1 as the engine rotation speed increases. However, if the swash-plate angle is locked by the stopper, the discharge flow rate of the hydraulic pump 10 increases in proportion with the engine rotation speed and the rotation speed of the agitating drum 1 tends to be excessive. Further, when the connection switch-over valve 20 is switched to the section C, the actuator 14 is prevented by the stopper from moving the swash-plate to a zero-degree position which corresponds to the full-stroke position of the plunger 75 so as to cause the discharge flow rate of the hydraulic pump 10 to be zero.

The function of the orifices 26 is to satisfy the following condition: making an increase in the discharge flow rate of the hydraulic pump 10 become more gentle as the engine rotation speed increases in the middle and high rotation speed regions without preventing the plunger 75 from driving the swash-plate 64 to the zero-degree position when the discharge pressure of the hydraulic pump 10 is applied to the actuator 14 as a result of a switching the connection switch-over valve to the section C.

Making the increase in the discharge flow rate of the hydraulic pump 10 become more gentle as the engine rotation speed increases means that the increase rate of the discharge flow rate of the hydraulic pump 10 decreases with respect to an increase rate of the engine rotation speed as the engine rotation speed increases.

In this embodiment, the orifices 26 are formed in the outer tube 75*a* to directly connect the actuator passage 18 and the reservoir outside the outer tube 75*a*, and hence the orifices 26 substantially function as the drain passage 25. Accordingly, the operation characteristics of the hydraulic pump 10 can be set in a preferable manner without increasing the number of parts of the agitating drum driving device.

The agitating drum driving device described above maintains the discharge flow rate of the hydraulic pump 10 at a constant low level when the internal combustion engine 60 is running idle or in a low rotation speed region, while increasing the discharge flow rate of the hydraulic pump 10 to a range corresponding to a rated rotation speed of the agitating drum 1 when the internal combustion engine 60 is running in a middle or high rotation speed region. According to this agitating drum driving device, therefore, the fuel consumption amount of the internal combustion engine 60 can be reduced without affecting the operation of the agitating drum 1.

The contents of Tokugan 2006-154718, with a filing date of Jun. 2, 2006 in Japan, are hereby incorporated by reference.

Although the invention has been described above with reference to a certain embodiment of the invention, the invention is not limited to the embodiment described above. Modifications and variations of the embodiment described above will occur to those skilled in the art, within the scope of the claims.

For example, it is not indispensable to form a plurality of the orifices 26 in the outer tube 75*a*. It is possible to form only one orifice 26 in the outer tube 75*a* as long as the condition described above is satisfied.

The internal combustion engine 60 may be replaced by any kind of combustion engine.

The embodiments of this invention in which an exclusive property or privilege is claimed are defined as follows:

What is claimed is:

1. A concrete agitating drum driving device comprising:

a hydraulic motor connected to a concrete agitating drum;

a hydraulic pump driven by a combustion engine and causing the hydraulic motor to rotate by supplying pressurized oil thereto;

a hydraulic actuator which regulates a flow rate of the pressurized oil in response to an actuator driving pressure;

a load sensing valve which generates the actuator driving pressure by reducing a pressure of the pressurized oil to maintain a differential pressure between the pressure of the pressurized oil and a load pressure under which the hydraulic motor operates at a constant level when an engine rotation speed of the combustion engine is not higher than a predetermined speed; and a mechanism which, when the engine rotation speed is higher than the predetermined speed, increases the flow rate of the pressurized oil as the engine rotation speed increases, while relatively decreasing an increase rate of the flow rate with respect to an increase rate of the engine rotation speed as the engine rotation speed increases.

2. The concrete agitating drum driving device as defined in claim 1, wherein the hydraulic actuator is a linear actuator, and the mechanism comprises a passage which releases a part of the actuator driving pressure when the actuator strokes beyond a predetermined stroke distance.

3. The concrete agitating drum driving device as defined in claim 2, wherein the passage comprises an orifice.

4. The concrete agitating drum driving device as defined in claim 3, wherein the hydraulic actuator comprises an inner tube inside which the actuator driving pressure is lead, and a plunger having an outer tube fitted on an outer circumference of the inner tube so as to be free to slide in an axial direction, the actuator driving pressure in the inner tube exerts a thrust force on the plunger in the interior of the outer tube, and the orifice comprises a hole which connects the interior and the exterior of the outer tube so as to release a part of the actuator driving pressure in the inner tube to the exterior of the outer tube according to a relative displacement of the outer tube and the inner tube beyond a predetermined distance.

5. The concrete agitating drum driving device as defined in claim 4, wherein the hydraulic pump is a swash-plate type pump which varies the flow rate of the pressurized oil according to a swash-plate angle of a swash-plate, the hydraulic pump comprising a spring which supports the swash-plate in a direction for increasing the swash-plate angle, and the plunger pushes the swash-plate in a direction for decreasing the swash-plate angle against the spring.

6. The concrete agitating drum driving device as defined in claim 4, wherein the swash-plate type pump comprises a pump housing and the orifice is arranged to open onto a space in the pump housing.

7. The concrete agitating drum driving device as defined in claim 2, further comprising a connection switch-over valve which comprises a first section for selecting a direction of circulation of the pressurized oil between the hydraulic pump and the hydraulic motor and a second section which shuts off supply of the pressurized oil to the hydraulic motor, and a cut-off valve which supplies the pressure of the pressurized oil without reducing as the actuator driving pressure to the hydraulic actuator when the connection switch-over valve is in the second section.

8. The concrete agitating drum driving device as defined in claim 7, wherein the orifice is formed in a size that enables the actuator to reduce the flow rate of the pressurized oil to zero when the pressure of the pressurized oil is supplied to the hydraulic actuator without reducing as the actuator driving pressure.

9. The concrete agitating drum driving device as defined in claim 1, wherein the flow rate of the pressurized oil when the engine rotation speed is not higher than the predetermined speed is set to be smaller than a flow rate of the pressurized oil corresponding to a rated rotation of the agitating drum.

* * * * *